US011656649B2

(12) United States Patent
Berry et al.

(10) Patent No.: US 11,656,649 B2
(45) Date of Patent: May 23, 2023

(54) PLATFORM CONTROL SYSTEM FOR BOOM LIFTS

(71) Applicants: ZOOMLION Heavy Industry NA, Inc., Yorkville, WI (US); ZOOMLION Heavy Industry Science and Technology Co. Ltd., Changsha (CN)

(72) Inventors: Dave Berry, Whitefish Bay, WI (US); Erik Goslawski, Burlington, WI (US)

(73) Assignees: ZOOMLION HEAVY INDUSTRY NA, INC., Yorkville, WI (US); ZOOMLION HEAVY INDUSTRY SCIENCE AND TECHNOLOGY CO. LTD, Changsha (CN)

( * ) Notice: Subject to any disclaimer, the term of this patent is extended or adjusted under 35 U.S.C. 154(b) by 342 days.

(21) Appl. No.: 17/096,998

(22) Filed: Nov. 13, 2020

(65) Prior Publication Data

US 2022/0155809 A1 May 19, 2022

(51) Int. Cl.
*G05G 9/047* (2006.01)
*B66F 11/04* (2006.01)

(52) U.S. Cl.
CPC ..... *G05G 9/047* (2013.01); *B66F 11/046* (2013.01)

(58) Field of Classification Search
None
See application file for complete search history.

(56) References Cited

U.S. PATENT DOCUMENTS

| | | | | |
|---|---|---|---|---|
| 4,574,651 | A * | 3/1986 | Nordstrom | G05G 1/01 244/234 |
| 8,276,476 | B2 * | 10/2012 | Diccion | E02F 9/2004 180/315 |
| 8,380,402 | B2 * | 2/2013 | Hobenshield | E02F 9/2004 700/83 |
| 2009/0055058 | A1 * | 2/2009 | Morris | E02F 9/2004 701/50 |
| 2015/0284219 | A1 * | 10/2015 | McConnell | B60P 3/12 414/800 |
| 2017/0294935 | A1 * | 10/2017 | Jacobs | H04M 1/185 |
| 2020/0317279 | A1 * | 10/2020 | Mastronardi | E02F 9/2004 |

* cited by examiner

*Primary Examiner* — Vicky A Johnson
(74) *Attorney, Agent, or Firm* — Donald J. Ersler

(57) ABSTRACT

A platform control system for boom lifts preferably includes a control panel, a left joystick and a right joystick. The left joystick includes a plurality of left ON-OFF-ON rocker switches and a plurality of left ON-OFF push button switches. The right joystick includes a plurality of right ON-OFF-ON rocker switches and a plurality of right ON-OFF push button switches. The left and right joysticks can be configured to work on a telescopic boom lift machine as well as on an articulating boom lift machine. The control panel preferably includes a display screen and a screen shroud. The display screen is mounted in a middle of the control panel. The display screen includes a plurality of proceed lights, warning lights and error lights pertaining to the functions of the left and right joysticks. The screen shroud partially covers the display screen to eliminate sun glare.

19 Claims, 9 Drawing Sheets

PLATFORM CONTROL SYSTEM FOR BOOM LIFTS

BACKGROUND OF THE INVENTION

1. Field of the Invention

The present invention relates generally to heavy equipment and more specifically to a platform control system for boom lifts, which includes left and right joysticks for movement of a boom lift.

2. Discussion of the Prior Art

It appears that the prior art does not disclose a platform control system for boom lifts, which includes left and right joysticks for movement of a boom lift.

Accordingly, there is clearly felt need in the art for a platform control system for boom lifts, which includes left and right joysticks for movement of a boom lift and other functions; which includes all boom lift control buttons located on left and right joystick; and which includes an operator having better control of the machine, because the operator does not have to take their hands off the left and right joysticks or look at a control panel to activate some function of the boom lift.

SUMMARY OF THE INVENTION

The present invention provides a platform control system for boom lifts, which includes left and right joysticks for movement of a boom lift. The platform control system for boom lifts (boom lift control system) preferably includes a control panel, a left joystick and a right joystick. The left joystick includes a left palm grip shaped handle; a left platform ON-OFF-ON rocker switch for controlling a platform rotation; a left height ON-OFF-ON rocker switch for controlling lowering and raising of a jib; a left articulating ON-OFF-ON rocker switch for controlling folding and unfolding of an articulating upper boom; a left extension ON-OFF-ON rocker switch for controlling the extension and retraction of the articulating upper boom; a left leveling ON-OFF-ON rocker switch for controlling platform leveling; and a left disabling ON-OFF push button for enabling and disabling a function of all the switches assembled on the left joystick. The left disabling ON-OFF push button acts as an additional safety mechanism to prevent the inadvertent actuation of both the left joystick and the switches mounted to the left joystick.

The right joystick includes a right palm grip shaped handle; a right slewing ON-OFF rocker switch for controlling the slewing of a turret; a right stability ON-OFF-ON rocker switch for controlling the extension and retraction of the axles; a right jib ON-OFF-ON rocker switch for controlling the extension and retraction of the jib; a right crabbing ON-OFF push button for controlling crab steering of the wheels; a right coordination ON-OFF push button switch for controlling coordinated steering of the wheels; and a right disabling ON-OFF push button for enabling and disabling a function of all the switches on the right joystick. The left and right joysticks can be configured to work on a telescopic boom lift machine as well as on an articulating boom lift machine. When using the boom lift control system for boom lifts for a telescopic boom lift platform, the rocker switch controlling the folding and unfolding of the articulating upper boom, and the rocker switch controlling the extension and retraction of the articulating upper boom are not installed. The mounting hole of these switches may be plugged with a cap.

The control panel preferably includes a display screen, a plurality of switches, a rotary knob, a display light and a screen shroud. The display screen is mounted in a middle of the control panel. The display screen includes a plurality of proceed lights, a plurality of warning lights and a plurality of error lights pertaining to the functions of the left and right joysticks. The screen shroud partially covers the display screen to eliminate sun glare. The plurality of switches, the rotary knob and the display light are located on left and right open areas of the control panel. A horn button and an emergency stop button are located in front of the display screen.

Accordingly, it is an object of the present invention to provide a boom lift control system, which includes left and right joysticks for movement of a boom lift and other functions.

It is another object of the present invention to provide a boom lift control system, which includes all boom lift control buttons located on left and right joystick.

Finally, it is another object of the present invention to provide a boom lift control system, which includes an operator having better control of the machine, because the operator does not have to take their hands off the left and right joysticks or look at a control panel to activate some function of the boom lift.

These and additional objects, advantages, features and benefits of the present invention will become apparent from the following specification.

DETAILED DESCRIPTION OF THE PREFERRED EMBODIMENTS

Figure 1:
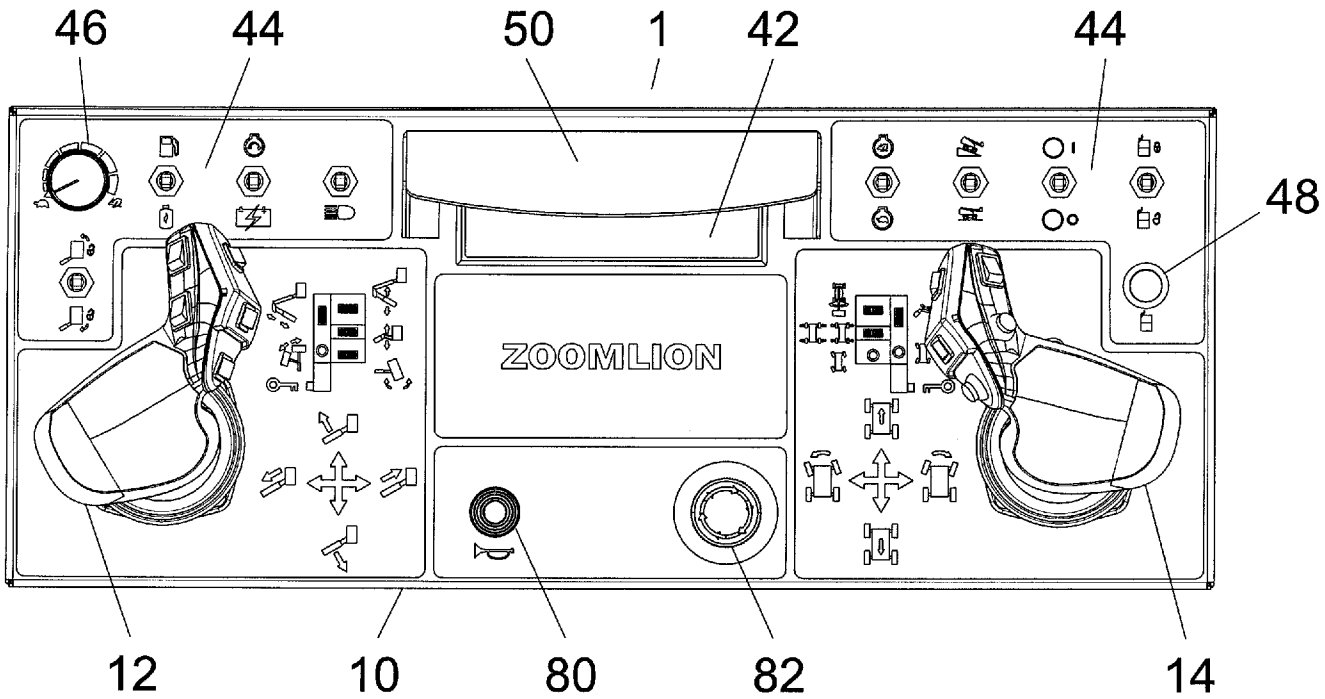
FIG. 1 is a top view of a boom lift control system in accordance with the present invention.
Figure 2:
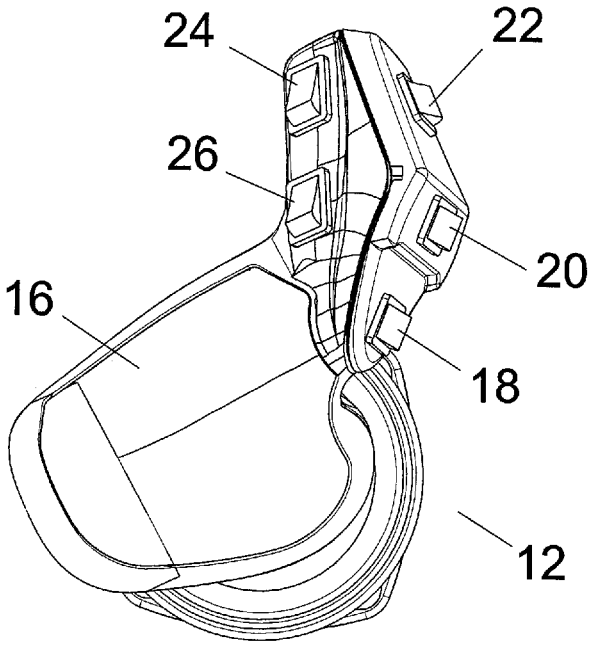
FIG. 2 is a top view of a left joystick illustrating a plurality of left switches of a boom lift control system in accordance with the present invention.
Figure 3:
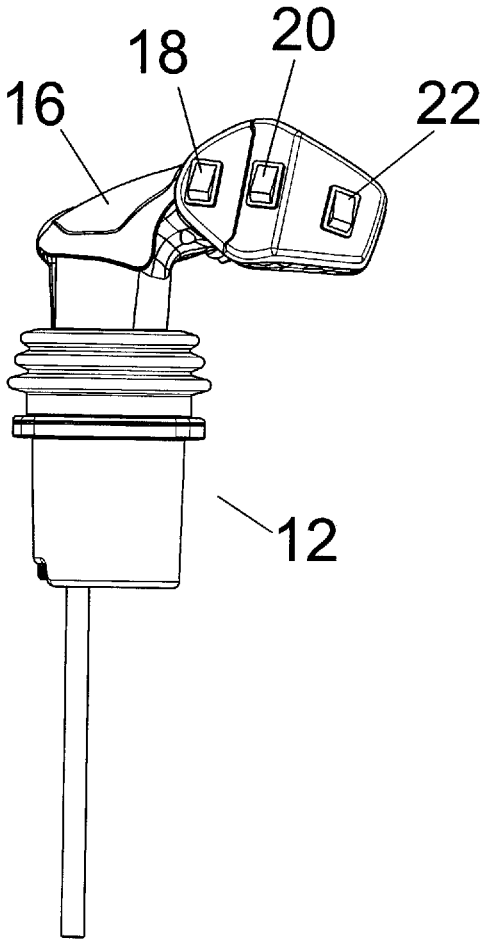
FIG. 3 is a front perspective view of a left joystick illustrating a plurality of left switches of a boom lift control system in accordance with the present invention.
Figure 4:
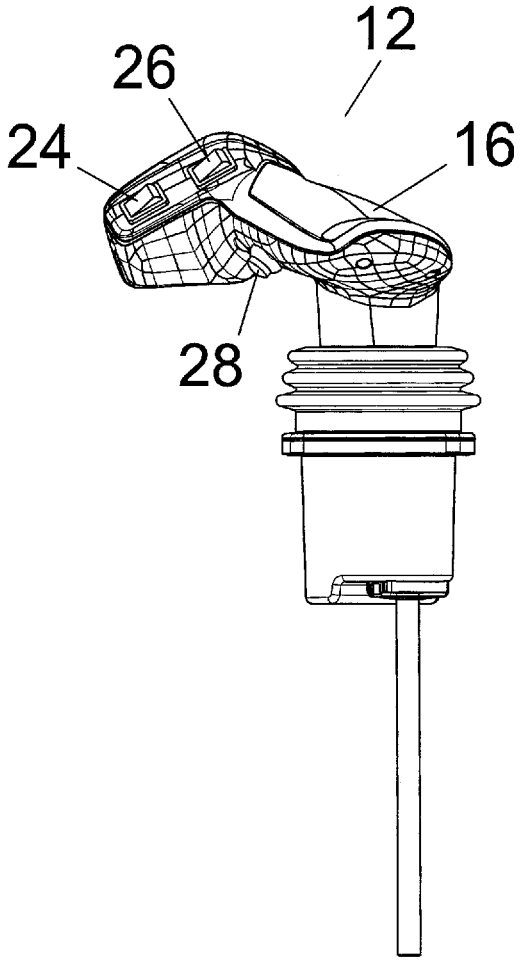
FIG. 4 is a rear perspective view of a left joystick illustrating a plurality of left switches of a boom lift control system in accordance with the present invention.

With reference now to the drawings, and particularly to FIG. 1, there is shown a top view of a boom lift control system 1. With reference to FIGS. 2-7, the boom lift control system 1 preferably includes a control panel 10, a left joystick 12 and a right joystick 14. With reference to FIGS. 2-4, the left joystick 12 includes a left palm grip shaped handle 16; a left platform ON-OFF-ON rocker switch 18 for controlling a platform rotation; a left height ON-OFF-ON rocker switch 20 for controlling lowering and raising of a jib; a left articulating ON-OFF-ON rocker switch 22 for controlling folding and unfolding of an articulating upper boom; a left extension ON-OFF-ON rocker switch 24 for controlling the extension and retraction of the articulating upper boom; a left leveling ON-OFF-ON rocker switch 26 for controlling platform leveling; and a left disabling ON-OFF push button 28 for enabling and disabling a function of all the switches assembled on the left joystick 12. With reference to FIG. 8, a schematic diagram of the ON-OFF-ON rocker switch 24 for controlling actuation of a cylinder 25 for extension and retraction of the articulating upper boom. The control panel 10 includes a control board 27 for receiving input from the left and right joysticks 12, 14. The control board 27 which sends an electrical output to a solenoid valve 29. Hydraulic outputs of the solenoid valve 29 send hydraulic fluid to a cylinder 31. A position of the ON-OFF-ON switch 24 determines whether the articulating upper boom is raised or lower. The left disabling ON-OFF push button 28 acts as an additional safety mechanism to prevent the inadvertent actuation of both the left joystick 12 and the switches 18, 20, 22, 24 and 26 mounted to the left joystick.

Figure 5:
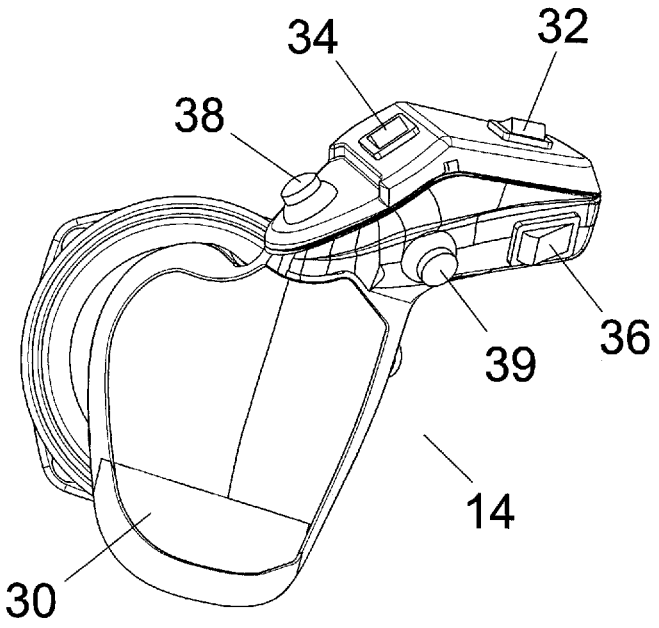
FIG. 5 is a top view of a right joystick illustrating a plurality of left switches of a boom lift control system in accordance with the present invention.
Figure 6:
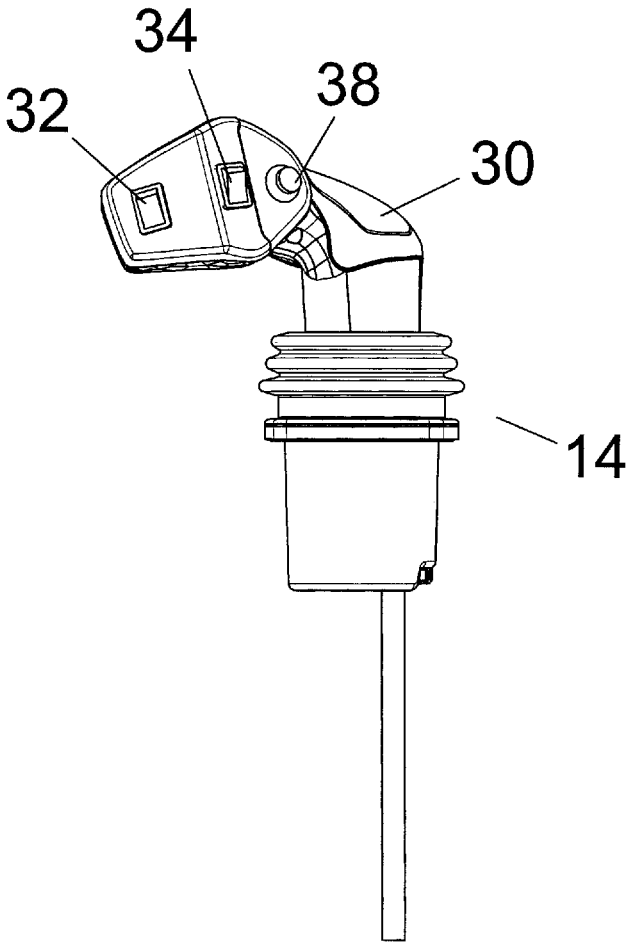
FIG. 6 is a front perspective view of a right joystick illustrating a plurality of left switches of a boom lift control system in accordance with the present invention.
Figure 7:
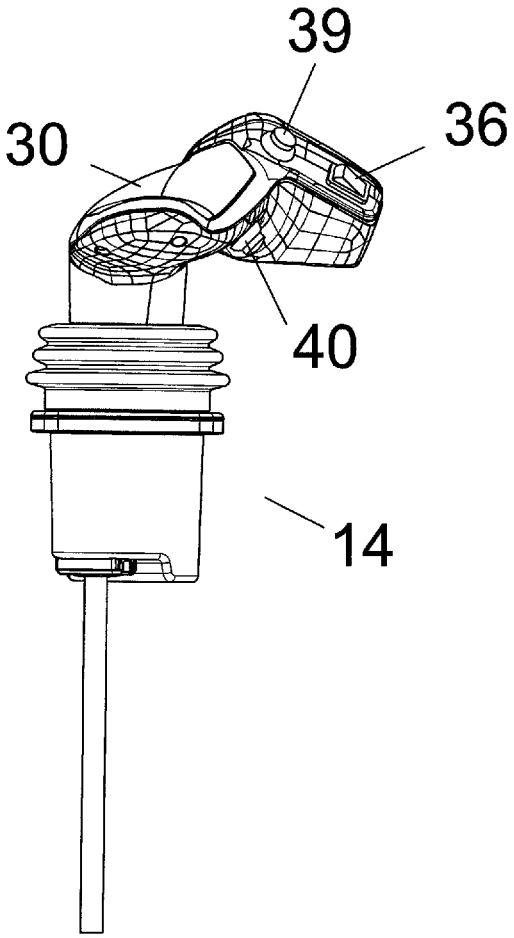
FIG. 7 is a side perspective view of a left joystick illustrating a plurality of left switches of a boom lift control system in accordance with the present invention.
Figure 8:
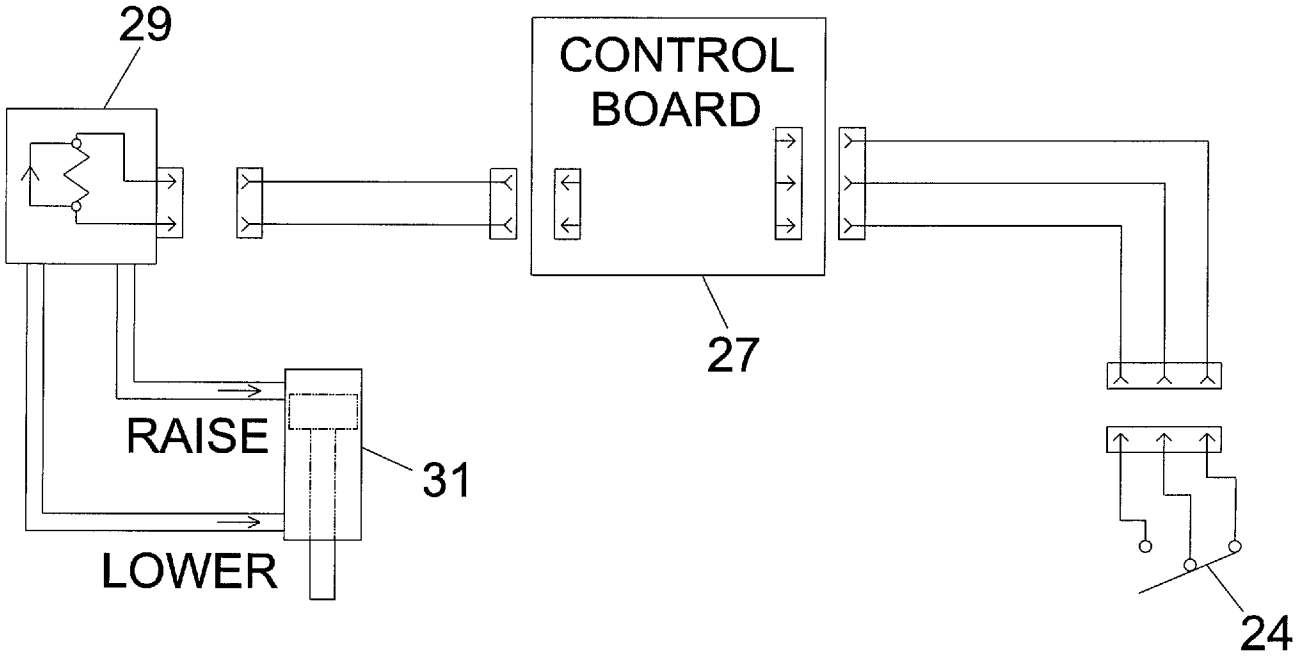
FIG. 8 is an electrical schematic of an On-Off-On switch connected to a solenoid of a flow valve of a boom lift control system in accordance with the present invention.

With reference to FIGS. 5-7, the right joystick 14 includes a right palm grip shaped handle 30; a right slewing ON-OFF rocker switch 32 for controlling the slewing of a turret; a right stability ON-OFF-ON rocker switch 34 for controlling the extension and retraction of the axles; a right jib ON-OFF-ON rocker switch 36 for controlling the extension and retraction of the jib; a right crabbing ON-OFF push button 38 for controlling crab steering of the wheels; a right coordination ON-OFF push button switch 39 for controlling coordinated steering of the wheels; and a right disabling ON-OFF push button 40 for enabling and disabling a function of all the switches on the right joystick.

The left and right joysticks 12, 14 can be configured to work on a telescopic boom lift machine as well as on an articulating boom lift machine. When using the platform control system 1 for boom lifts for a telescopic boom lift platform, the rocker switch 22 controlling the folding and unfolding of the articulating upper boom, and the rocker switch 24 controlling the extension and retraction of the articulating upper boom are not installed. The mounting hole of these switches may be plugged with a cap.

Figure 9:
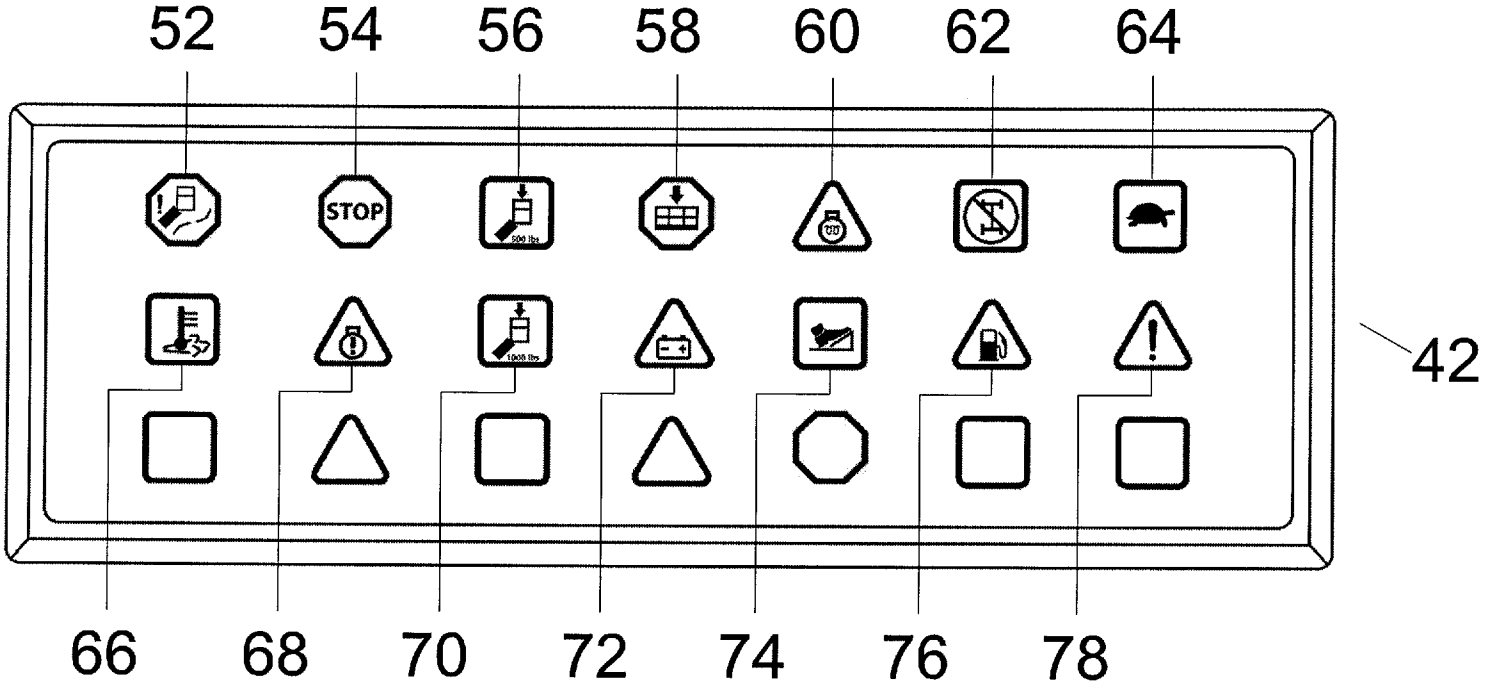
FIG. 9 is a top view of display screen of a control panel of a boom lift control system in accordance with the present invention.

With reference to FIG. 1, the control panel 10 preferably includes a display screen 42, a plurality of switches 44, a rotary knob 46, a display light 48 and a screen shroud 50. The display screen 42 is mounted in a middle of the control panel 10. With reference to FIG. 9, the display screen 42 includes a boom cable failure indicator light 52, an e-stop indicator light 54, a 500 lbs. unrestricted capacity indicator light 56, a platform overload indicator light 58, a glow plug indicator light 60, a drive and steer disable indicator light 62, a creep mode indicator light 64, an emissions temperature indicator light 66, an engine error light indicator 68, a 1000 lbs. restricted capacity indicator light 70, a battery malfunction light 72, an enable light indicator 74, a low fuel indicator light 76 and a machine malfunction indicator light 78.

The above proceed lights, warning lights and error lights pertain to the functions of the left and right joysticks 12, 14. The screen shroud 50 partially covers the display screen 42 to eliminate sun glare. The plurality of switches 44, the rotary knob 46 and the display light 48 are located to the left and right of the display screen 42 in open areas of the control panel 10. A horn button 80 and an emergency stop button 82 are located in front of the display screen 42.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A platform control system for boom lifts comprising:

a control panel includes a display screen;

a left joystick includes a plurality of left On-Off-On switches and at least one left On-Off switch; and a right joystick includes a plurality of right On-Off-On switches and at least one right On-Off switch, wherein an operator does not have to remove their hands from either of said left and right joysticks to activate one of said switches; and a screen shroud covers a portion of said display screen to prevent glare.

2. The platform control system for boom lifts of claim 1 wherein:

said display screen includes a plurality of proceed lights, a plurality of warning lights and a plurality of error lights pertaining to the functions of said left and right joysticks.

3. The platform control system for boom lifts of claim 1 wherein:

a left articulating ON-OFF-ON rocker switch on said left joystick for controlling folding and unfolding of an articulating upper boom.

4. The platform control system for boom lifts of claim 1 wherein:

a left extension ON-OFF-ON rocker switch on said left joystick for controlling an extension and retraction of said articulating upper boom.

5. The platform control system for boom lifts of claim 1 wherein:

a left disabling ON-OFF push button on said left joystick for enabling and disabling a function of all said switches on said left joystick; and a right disabling ON-OFF push button on said right joystick for enabling and disabling a function of all said switches on said right joystick.

6. The platform control system for boom lifts of claim 1 wherein:

a right crabbing ON-OFF push button on said right joystick for controlling crab steering of wheels.

7. The platform control system for boom lifts of claim 1 wherein:

a right coordination ON-OFF push button switch on said right joystick for controlling coordinated steering of a plurality of wheels.

8. A platform control system for boom lifts comprising:

a control panel includes a display screen;

a left joystick includes a plurality of left On-Off-On switches and at least one left On-Off switch, one of said plurality of left On-Off-On switches controls a platform rotation; and a right joystick includes a plurality of right On-Off-On switches and at least one right On-Off switch, one of said plurality of right On-Off-On switches controls extension and retraction of axles.

9. The platform control system for boom lifts of claim 8, further comprising:

a screen shroud covers a portion of said display screen to prevent glare.

10. The platform control system for boom lifts of claim 8 wherein:

said display screen includes a plurality of proceed lights, a plurality of warning lights and a plurality of error lights pertaining to the functions of the left and right joysticks.

11. The platform control system for boom lifts of claim 8 wherein:

a left articulating ON-OFF-ON rocker switch on said left joystick for controlling folding and unfolding of an articulating upper boom.

12. The platform control system for boom lifts of claim 8 wherein:

a left extension ON-OFF-ON rocker switch on said left joystick for controlling an extension and retraction of an articulating upper boom.

13. The platform control system for boom lifts of claim 8 wherein:

a left disabling ON-OFF push button on said left joystick for enabling and disabling a function of all said switches on said left joystick; and a right disabling ON-OFF push button on said right joystick for enabling and disabling a function of all said switches on said right joystick.

14. The platform control system for boom lifts of claim 8 wherein:

a right crabbing ON-OFF push button on said right joystick for controlling crab steering of wheels.

15. The platform control system for boom lifts of claim 8 wherein:

a right coordination ON-OFF push button switch on said right joystick for controlling coordinated steering of a plurality of wheels.

16. A platform control system for boom lifts comprising:

a control panel includes a display screen;

a left joystick includes a plurality of left On-Off-On switches and at least one left On-Off switch, one of said plurality of left On-Off-On switches controls a platform rotation, another one of said plurality of left On-Off-On switches controls lowering and raising of a jib; and a right joystick includes a plurality of right On-Off-On switches and at least one right On-Off switch, one of said plurality of right On-Off-On switches controls extension and retraction of the axles, another one of said plurality of right On-Off-On switches controls extension and retraction of said jib.

17. The platform control system for boom lifts of claim 16, further comprising:

a screen shroud covers a portion of said display screen to prevent glare.

18. The platform control system for boom lifts of claim 16 wherein:

said display screen includes a plurality of proceed lights, a plurality of warning lights and a plurality of error lights pertaining to the functions of the left and right joysticks.

19. The platform control system for boom lifts of claim 16 wherein:

a left disabling ON-OFF push button on said left joystick for enabling and disabling a function of all of said switch on said left joystick; and a right disabling ON-OFF push button on said right joystick for enabling and disabling a function of all of said switches on said right joystick.

* * * * *